US009777424B2

(12) United States Patent
Lee et al.

(10) Patent No.: US 9,777,424 B2
(45) Date of Patent: Oct. 3, 2017

(54) WASHING MACHINE HAVING DETERGENT SUPPLY DEVICE

(71) Applicant: SAMSUNG ELECTRONICS CO., LTD., Suwon-si (KR)

(72) Inventors: Jin Ho Lee, Suwon-si (KR); Han Kyu Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 918 days.

(21) Appl. No.: 13/975,632

(22) Filed: Aug. 26, 2013

(65) Prior Publication Data

US 2014/0053614 A1 Feb. 27, 2014

(30) Foreign Application Priority Data

Aug. 27, 2012 (KR) ..... 10-2012-0093978

(51) Int. Cl.
*D06F 39/02* (2006.01)

(52) U.S. Cl.
CPC ..... *D06F 39/024* (2013.01); *D06F 39/02* (2013.01); *D06F 39/028* (2013.01)

(58) Field of Classification Search
CPC ..... D06F 39/02; D06F 39/028
See application file for complete search history.

(56) References Cited

U.S. PATENT DOCUMENTS 7,654,119 B2 * 2/2010 Song ..... D06F 39/02 68/17 R
2005/0229645 A1 * 10/2005 Kim ..... D06F 39/028 68/17 R
2012/0167637 A1 * 7/2012 Mun ..... D06F 39/02 68/13 R

FOREIGN PATENT DOCUMENTS

| | | |
|---|---|---|
| EP | 0 331 920 A2 | 9/1989 |
| EP | 0 913 513 A2 | 5/1999 |
| EP | 1 607 509 A1 | 12/2005 |
| WO | 2010/003961 A1 | 1/2010 |

OTHER PUBLICATIONS

European Search Report dated Sep. 17, 2015 issued in corresponding European Patent Application 13181733.0.
Decision on Grant (Communication under Rule 71(3) EPC) dated Mar. 27, 2017 in corresponding European Patent Application No. 13181733.0 (7 pages).

* cited by examiner

*Primary Examiner* — David Cormier
(74) *Attorney, Agent, or Firm* — Staas & Halsey LLP

(57) ABSTRACT

A washing machine equipped with a detergent supply device has an improved component coupling structure capable of enhancing productivity. A washing machine includes a main body, a drum rotatably mounted in the main body, and a detergent supply device disposed at an upper portion of the main body to supply a detergent into the drum. The detergent supply device includes a housing, a detergent case to store a detergent, the detergent case being movably coupled to the housing, a water supply frame coupled to an upper portion of the housing to guide water to the detergent case, and a cover frame to sealingly cover an upper portion of the water supply frame, the cover frame including a plurality of coupling protrusions protruding from an inner peripheral surface thereof to support a bottom surface of the water supply frame.

18 Claims, 10 Drawing Sheets

WASHING MACHINE HAVING DETERGENT SUPPLY DEVICE

CROSS-REFERENCE TO RELATED APPLICATIONS

This application claims the priority benefit of Korean Patent Application No. 10-2012-0093978, filed on Aug. 27, 2012, in the Korean Intellectual Property Office, the disclosure of which is incorporated herein by reference.

BACKGROUND

1. Field

The following description relates to a washing machine having a detergent supply device to supply a detergent to the inside of the washing machine.

2. Description of the Related Art

A washing machine is an appliance that washes laundry using electric power. In general, a washing machine comprises a tub to store wash water, a drum rotatably mounted in the tub, a pulsator rotatably mounted on a bottom of the drum, and a motor to rotate the drum and the pulsator.

After laundry and wash water containing a detergent are put in the drum, the drum and the pulsator are rotated by the motor, and the pulsator stirs the laundry placed in the drum together with the wash water to remove dirt from the laundry.

In general, a detergent supply device of a drum washing machine includes a detergent storage unit to store at least one of a solid detergent and a liquid detergent, and a water supply unit to supply water to the detergent storage unit. The water supply unit includes an upper frame and a lower frame that may be thermal welded to each other to prevent water leakage.

However, if the upper frame and the lower frame of the water supply unit may not be perfectly thermal welded, water leakage through an imperfectly welded portion may occur when a pressure of water supplied from an external water source is relatively high. Due to the water leakage, water to be supplied to only a solid detergent may be undesirably supplied to a liquid detergent or a fabric softener. Therefore, a user may not obtain desired washing result. In addition, a thermal welding process with respect to the upper and lower frames may increase manufacturing costs.

SUMMARY

It is an aspect of the present disclosure to provide a washing machine equipped with a detergent supply device having an improved structure capable of preventing water leakage.

It is another aspect of the present disclosure to provide a washing machine equipped with a detergent supply device having an improved structure in which water supplied to the detergent supply device is evenly distributed in the detergent supply device.

It is a further aspect of the present disclosure to provide a washing machine equipped with a detergent supply device having an improved component coupling structure capable of enhancing productivity.

Additional aspects of the disclosure will be set forth in part in the description which follows and, in part, will be apparent from the description, or may be learned by practice of the disclosure.

In accordance with one aspect of the present disclosure, a detergent supply device of a washing machine includes a housing having an opening, a detergent case to store a detergent, the detergent case being movably coupled to the housing through the opening, a water supply frame coupled to an upper portion of the housing to guide water to the detergent case, and a cover frame to sealingly cover an upper portion of the water supply frame, wherein the water supply frame includes a first passage rib to define a first water supply passage, a second passage rib to define a second water supply passage which communicates with the first water supply passage and guides water in a direction different from the first water supply passage, and at least one guide rib connecting the first passage rib and the second passage rib to enable water passing through the first water supply passage to flow toward the second water supply passage.

The water supply frame may further include at least one drain slot communicating with the first water supply passage and the second water supply passage and formed above the guide rib.

If a level of water in the water supply frame is lower than a height of the guide rib, the guide rib may guide water passing through the first water supply passage toward the second water supply passage, and if the level of water in the water supply frame is higher than the height of the guide rib, the guide rib may guide at least a part of water in the water supply frame toward the drain slot.

The guide rib may have a lower height than the first passage rib and the second passage rib.

The drain slot may be defined by the guide rib, the first passage rib and the second passage rib.

The water supply frame may further include at least one third passage rib disposed between the first passage rib and the second passage rib, and the third passage rib may include a first surface to define the first water supply passage with the first passage rib, and a second surface to define the second water supply passage with the second passage rib, the second surface being opposite to the first surface.

The cover frame may include a plurality of coupling protrusions protruding from an inner peripheral surface thereof to support a bottom surface of the water supply frame.

In accordance with another aspect of the present disclosure, a washing machine includes a main body, a drum rotatably mounted in the main body, and a detergent supply device disposed at an upper portion of the main body to supply a detergent into the drum, wherein the detergent supply device includes a housing, a detergent case to store a detergent, the detergent case being movably coupled to the housing, a water supply frame coupled to an upper portion of the housing to guide water to the detergent case, and a cover frame to sealingly cover an upper portion of the water supply frame, the cover frame including a plurality of coupling protrusions protruding from an inner peripheral surface thereof to support a bottom surface of the water supply frame.

The plurality of coupling protrusions may be arranged apart from each other along the inner peripheral surface of the cover frame.

Each of the coupling protrusions may include a contact surface configured to be in contact with the bottom surface of the water supply frame when the water supply frame and the cover frame are in a coupled state, and a slanted surface connecting the contact surface and the inner peripheral surface of the cover frame, the slanted surface being slanted downwardly from the contact surface to the inner peripheral surface of the cover frame.

The water supply frame may include a plurality of gap forming protrusions protruding from an outer bottom surface thereof and arranged corresponding to positions of the coupling protrusions so that a gap is formed between each of the gap forming protrusions and each of the coupling protrusions.

The cover frame may further include a plurality of locking hooks to fix the cover frame coupled with the water supply frame to the housing, and the plurality of locking hooks may be arranged along an outer peripheral surface of the cover frame.

The water supply frame may include a water supply passage through which water supplied from an external water source moves, a plurality of through-holes formed through the bottom surface of the water supply frame, through which water moving along the water supply passage drops into the detergent case, and at least one guide rib provided in the water supply passage and configured to enable water introduced into a portion of the water supply passage to change a moving direction and move toward another portion of the water supply passage.

The water supply passage may include at least one first water supply passage into which water supplied from an external water source is introduced, at least one second water supply passage configured to communicate with the first water supply passage and change a moving direction of water having passed through the first water supply passage, and at least one third water supply passages configured to communicate with the second water supply passage and change a moving direction of water having passed through the second water supply passage. The guide rib may be disposed at a junctional region between the second water supply passage and the third water supply passage to enable water passing through the second water supply passage to move toward the third water supply passage.

The third water supply passage may be disposed between the first water supply passage and the second water supply passage.

The second water supply passage may be provided in at least two parts which are arranged while interposing the first water supply passage therebetween.

The water supply frame may further include a plurality of passage ribs protruding from an inner bottom surface thereof to define the water supply passage, and the guide rib may have a lower height than the passage ribs.

The guide rib may have a first end connected to a surface of a first passage rib defining the first water supply passage and the third water supply passage, and a second end connected to a surface of a second passage rib defining the second water supply passage.

The water supply frame may further include at least one drain slot formed above the guide rib. If a level of water introduced into the water supply passage is higher than the guide rib, the drain slot may allow the water in the water supply passage to be discharged from the water supply frame.

The water supply frame may further include at least one drain slot defined by the cover frame, the first passage rib, the second passage rib and the guide rib.

The drain slot may communicate with the second water supply passage and the third water supply passage.

In accordance with a further aspect of the present disclosure, a washing machine includes a main body, a tub disposed in the main body to store wash water, and a detergent supply device disposed at an upper portion of the main body to supply a detergent into the tub, wherein the detergent supply device includes a lower frame to store a detergent, a middle frame coupled to an upper portion of the lower frame, the middle frame including at least one water supply passage through which water supplied from an external water source moves, and at least one through-hole formed through the water supply passage, through which water moving along the water supply passage drops into the lower frame, and an upper frame including a receiving part to receive the middle frame therein, and a plurality of coupling protrusions protruding from an inner surface of the receiving part to support a bottom surface of the middle frame so that the middle frame is fixed in the receiving part.

The plurality of coupling protrusions may be arranged apart from each other along an inner peripheral surface of the receiving part.

The upper frame may further include a plurality of locking hooks to fix the upper frame coupled with the middle frame to the lower frame.

The middle frame may further include a first water supply part to supply water to a solid detergent stored in the lower frame, and a second water supply part to supply water to a liquid detergent and a fabric softener stored in the lower frame.

The first water supply part may include at least one first drain slot to prevent water supplied to the first water supply part from moving to the second water supply part in a relatively high water pressure condition.

The middle frame may further include at least one drain passage provided between the first water supply part and the second water supply part to prevent water escaping from the first water supply part from moving to the second water supply part in a relatively high water pressure condition, and a plurality of second drain slots formed through the drain passage so that water moving along the drain passage is discharged to the lower frame.

The first water supply part may further include at least one guide rib to prevent water supplied to the first water supply part from being discharged through the first drain slot in a relatively low water pressure condition.

If a level of water introduced into the first water supply part is higher than the guide rib, a part of the water introduced into the first water supply part may be discharged to the outside of the detergent supply device through at least one of the first drain slot and the second drain slots.

As described above, since the components of the detergent supply device may be easily assembled by simple engagement methods, manufacturing processes may be simplified, and productivity may be enhanced.

In addition, even though a pressure of water supplied from an external water source is relatively high, water leakage may not occur. Further, in a relatively low water pressure condition, water supplied to the detergent supply device may be evenly distributed in the detergent supply device and then supplied to the detergent case. Accordingly, the washing machine may maintain superior washing performance, and thus operational reliability is increased.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
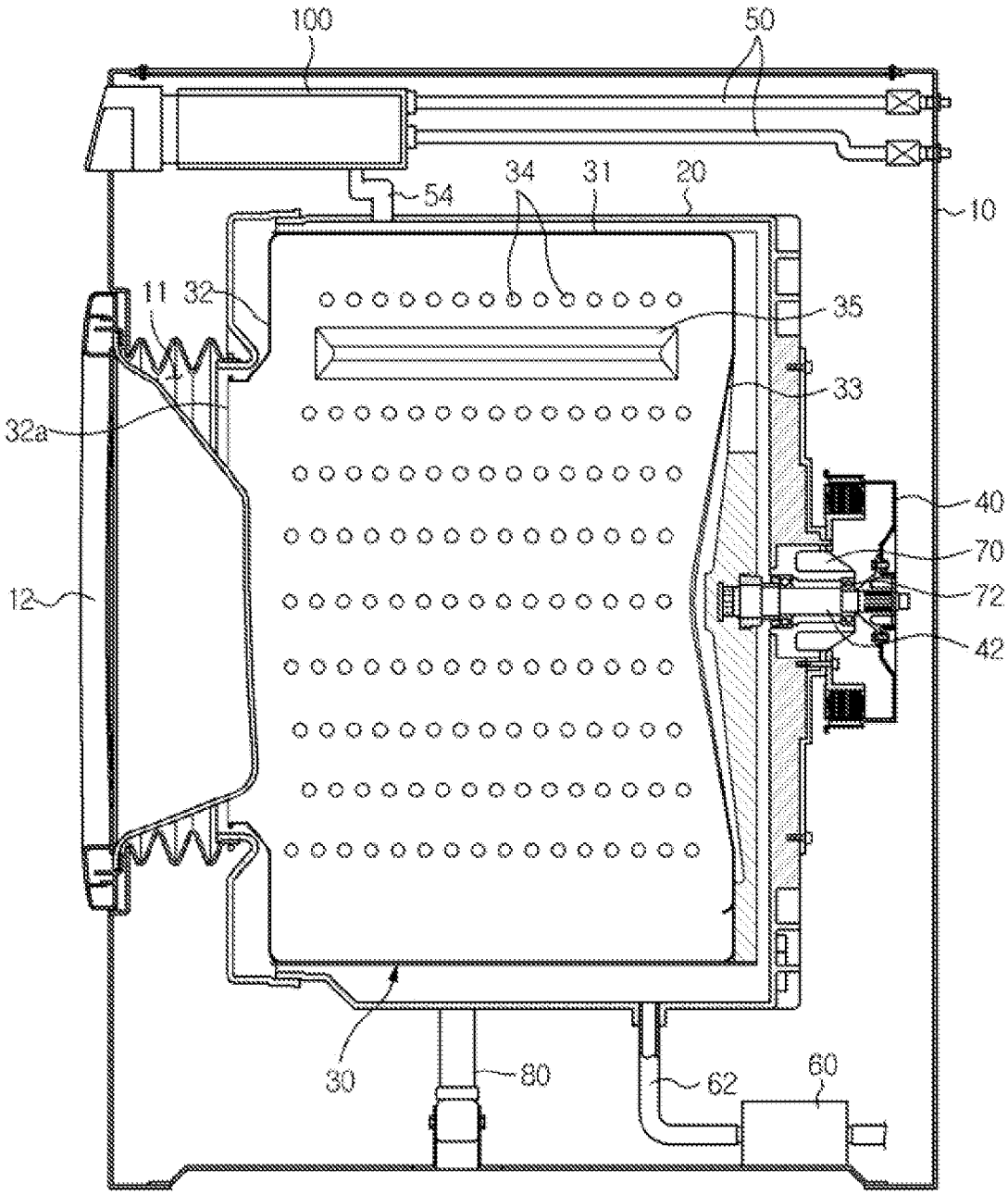
FIG. 1 is a view illustrating constitution of a washing machine according to an embodiment of the present disclosure.

Reference will now be made in detail to embodiments of the present disclosure, examples of which are illustrated in the accompanying drawings, wherein like reference numerals refer to like components throughout.

FIG. 1 is a view illustrating constitution of a washing machine according to an embodiment of the present disclosure.

As shown in FIG. 1, a washing machine 1 comprises a main body 10 defining an external appearance of the washing machine and supporting components mounted inside the main body 10, a tub 20 disposed in the main body 10, a drum 30 rotatably disposed in the tub 20, and a motor 40 to drive the drum 30.

The main body 10 is formed with a laundry entrance hole 11 at a front portion thereof, through which a user places laundry into the drum 30. A door 12 is provided at the front portion of the main body 10 in order to open and close the laundry entrance hole 11.

Water supply hoses 50 to supply wash water to the tub 20 are installed above the tub 20. One end portion of each of the water supply hoses 50 is connected to an external water supply source (not shown), and the other end portion of each of the water supply hoses 50 is connected to a detergent supply device 100.

The detergent supply device 100 is connected to the tub 20 through a connection pipe 54, and includes a detergent case 120 to store a detergent or a fabric softener. Water supplied through the water supply hoses 50 passes through the detergent case 120 and is mixed with the detergent or the fabric softener, and then the water containing the detergent or the fabric softener is supplied to the inside of the tub 20.

A drain pump 60 and a drain pipe 62 are mounted under the tub 20, in order to discharge water in the tub 20 to the outside of the main body 10.

The tub 20 is supported by a damper 80. The damper 80 connects an inner bottom surface of the main body 10 and an outer surface of the tub 20.

The drum 30 includes a cylindrical body 31, a front plate 32 provided at a front portion of the cylindrical body 31, and a rear plate 33 provided at a rear portion of the cylindrical body 31. The front plate 32 is formed with an opening 32*a* through which laundry is placed or removed into/from the drum 30. The rear plate 33 is connected with a driving shaft 42 to transmit power from the motor 40 to the drum 30.

A plurality of through-holes 34 for wash water circulation is formed through a peripheral surface of the drum 30. The drum 30 is also provided with a plurality of lifters 35 on an inner circumferential surface thereof, in order to lift laundry when the drum 30 rotates.

The driving shaft 42 is disposed between the drum 30 and the motor 40. One end portion of the driving shaft 42 is connected to the rear plate 33 of the drum 30, and the other end portion of the driving shaft 42 extends outside a rear wall of the tub 20. If the motor 40 drives the driving shaft 42, the drum 30 connected to the driving shaft 42 rotates about the driving shaft 42.

A bearing housing 70 is mounted to the rear wall of the tub 20 so as to rotatably support the driving shaft 42. The bearing housing 70 may be made of, for example, aluminum alloy, and may be inserted into the rear wall of the tub 20 when the tub 20 is formed by injection molding. Bearings 72 are disposed between the bearing housing 70 and the driving shaft 42 so that the driving shaft 42 may effectively rotate.

Hereinafter, a structure of the detergent supply device 100 according to the embodiment of the present disclosure will be explained.

Figure 2:
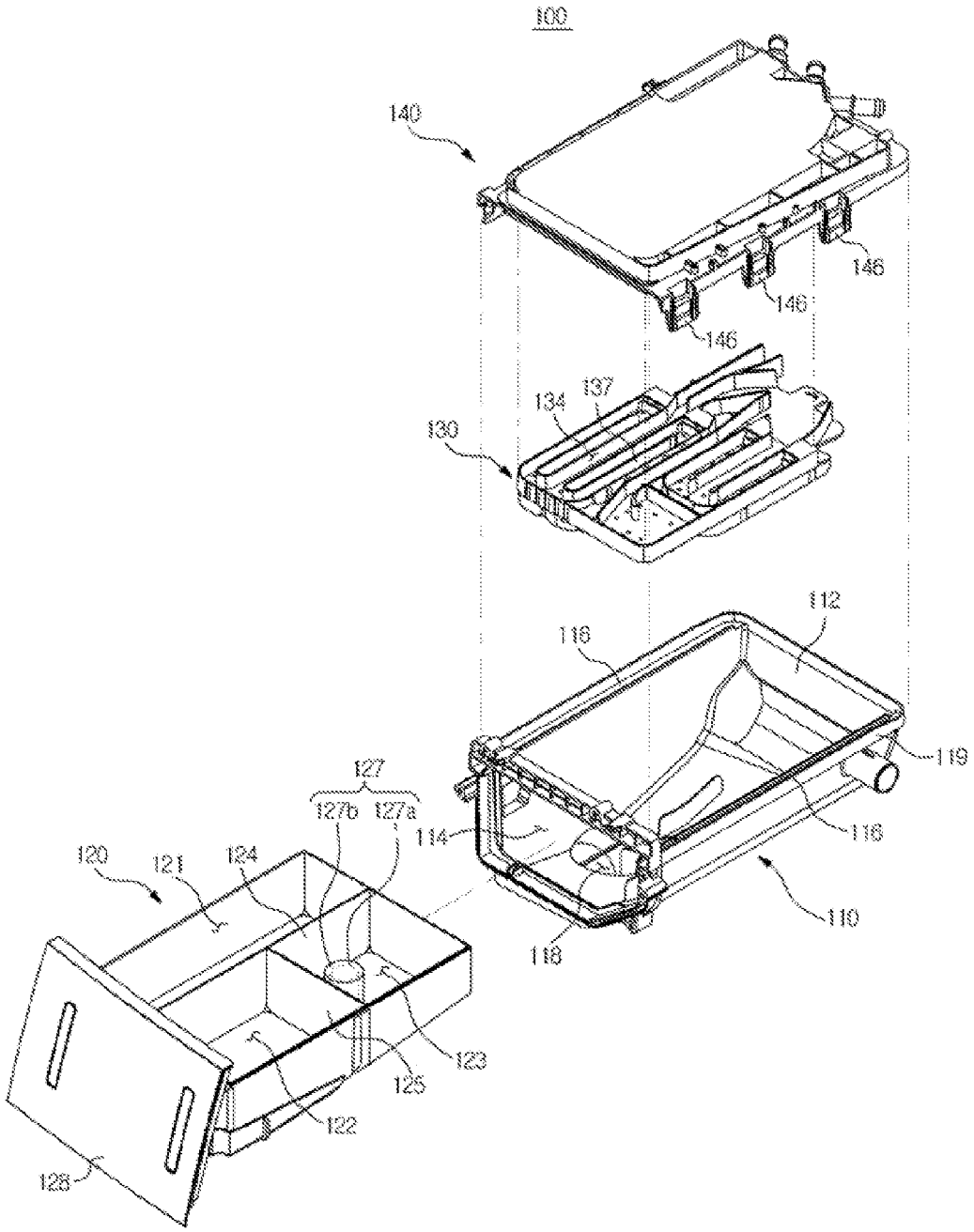
FIG. 2 is an exploded perspective view of a detergent supply device according to an embodiment of the present disclosure.
Figure 3:
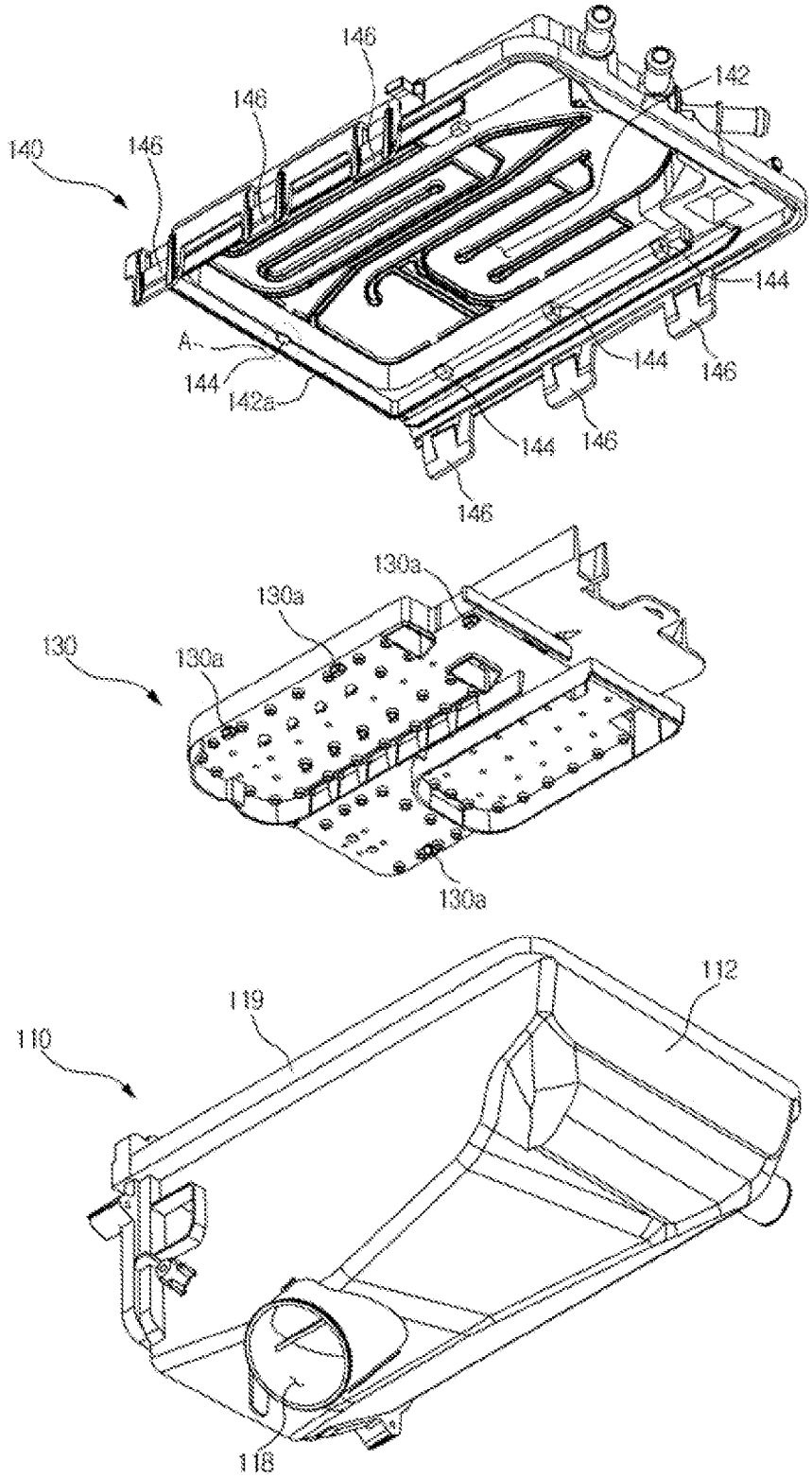
FIG. 3 is an exploded perspective view of the detergent supply device of FIG. 2, taken from a different angle.
Figure 4:
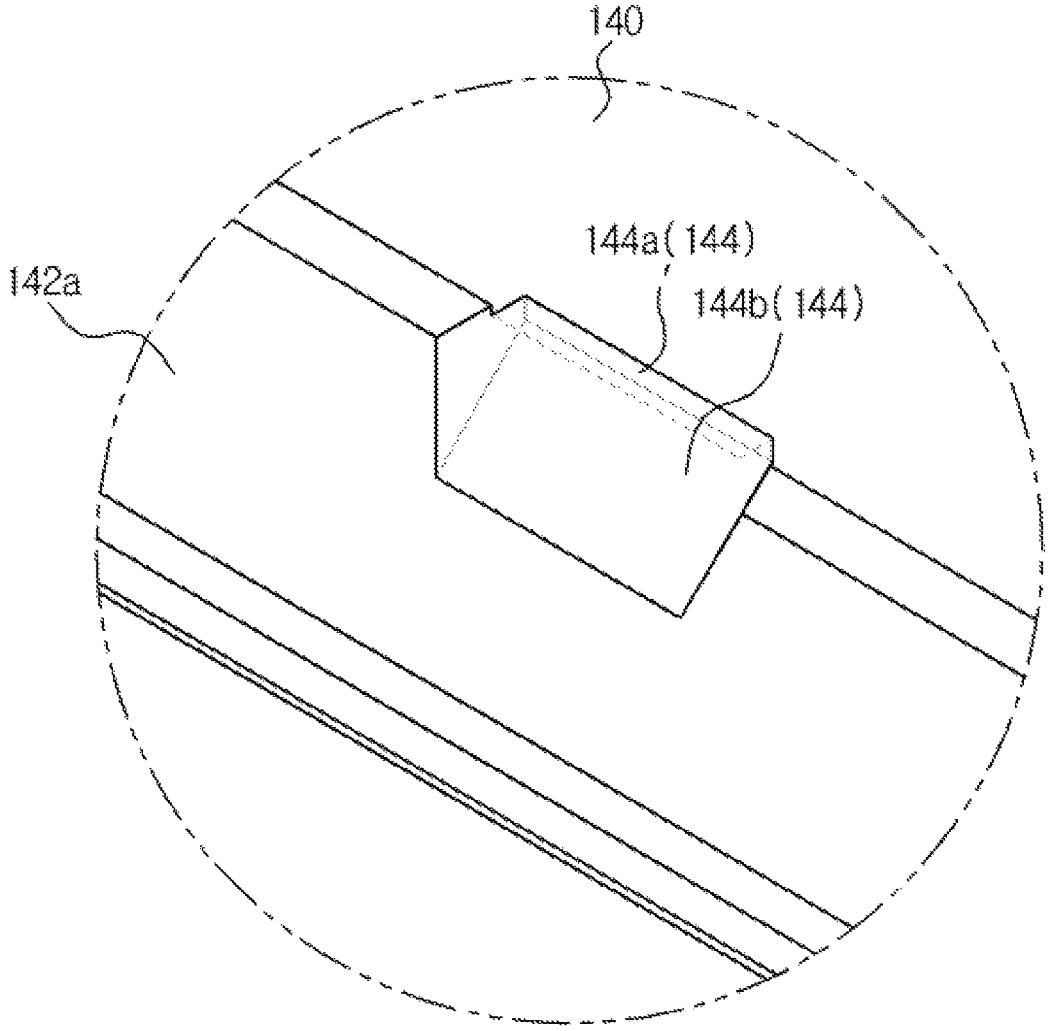
FIG. 4 is an enlarged view of an A portion in FIG. 3.
Figure 5:
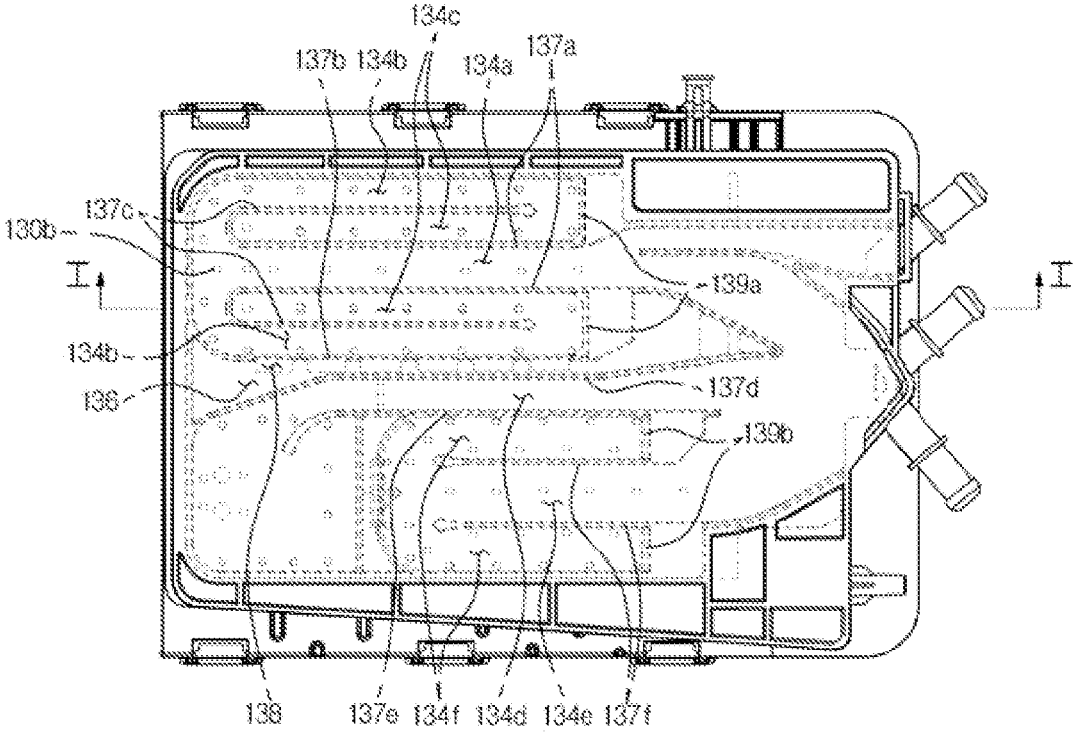
FIG. 5 is a plan view illustrating engagement of a water supply frame and a cover frame of the detergent supply device according to an embodiment of the present disclosure.
Figure 6:
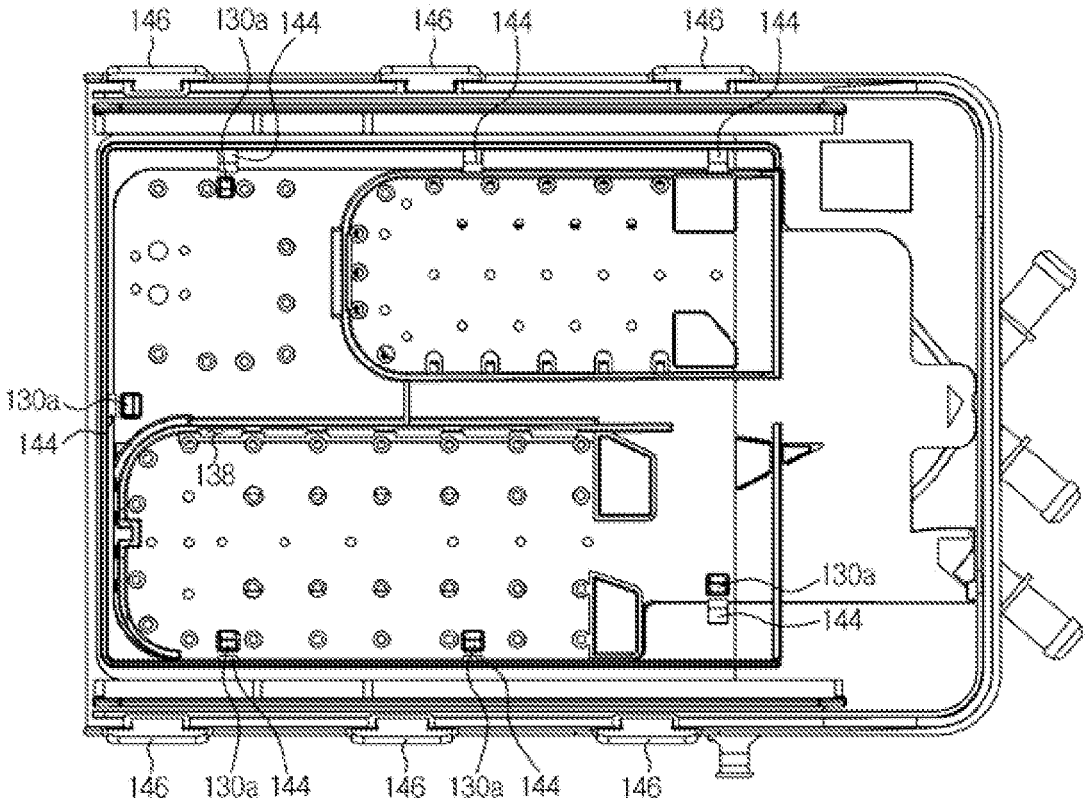
FIG. 6 is a bottom view illustrating engagement of the water supply frame and the cover frame of the detergent supply device according to an embodiment of the present disclosure.
Figure 7:
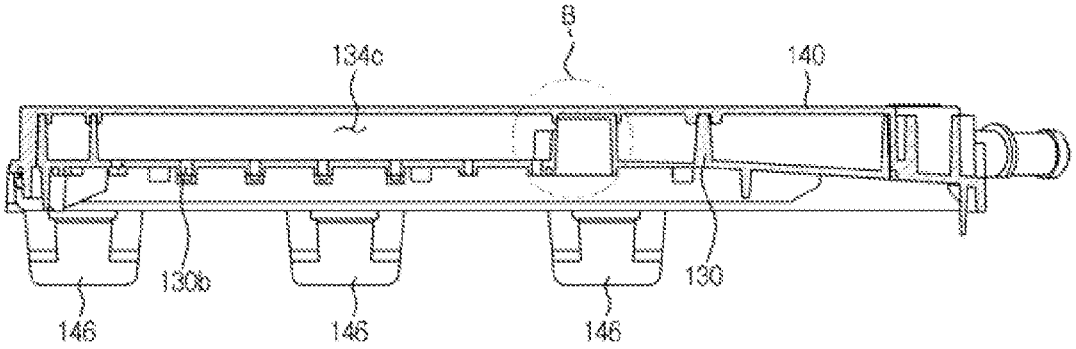
FIG. 7 is a sectional view taken along line I-I in FIG. 5.
Figure 8:
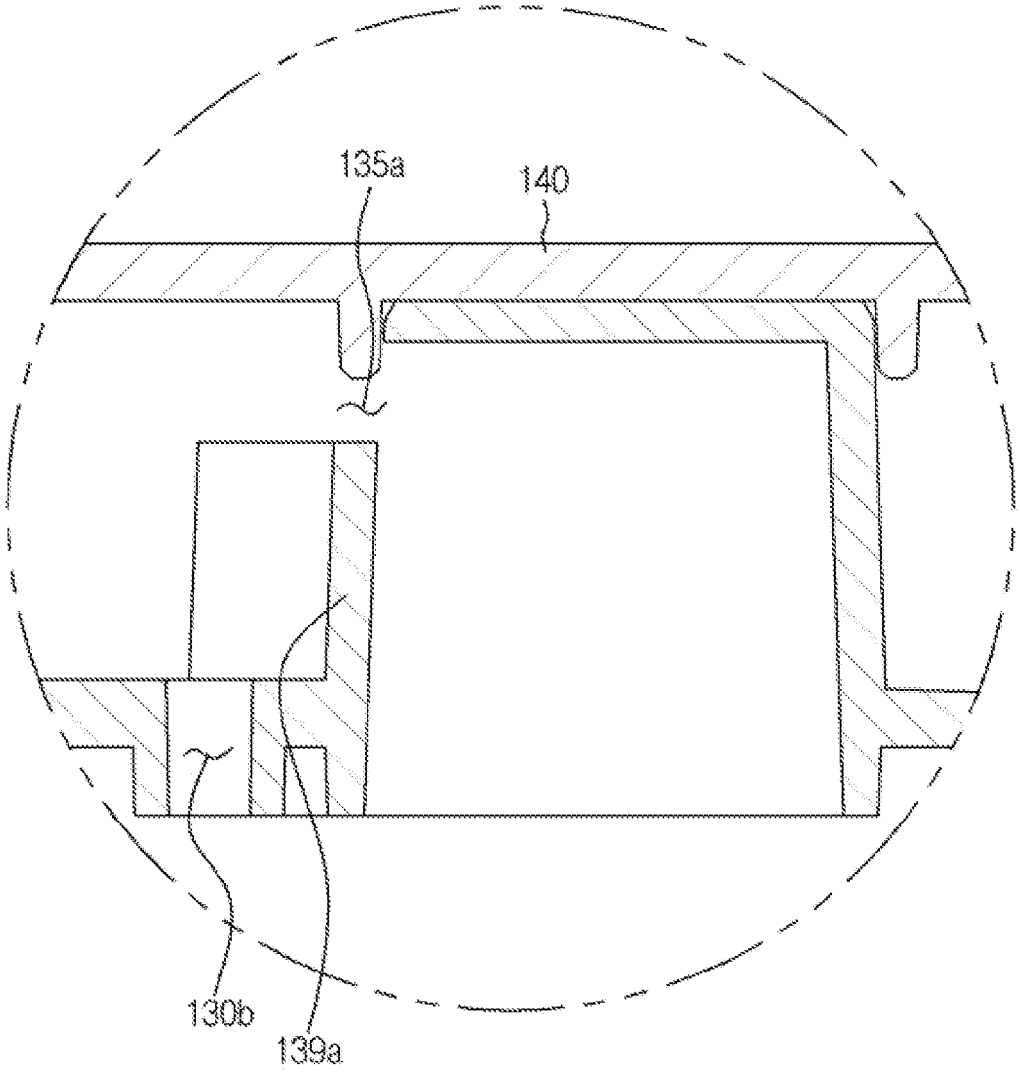
FIG. 8 is an enlarged view of a B portion in FIG. 7.
Figure 9:
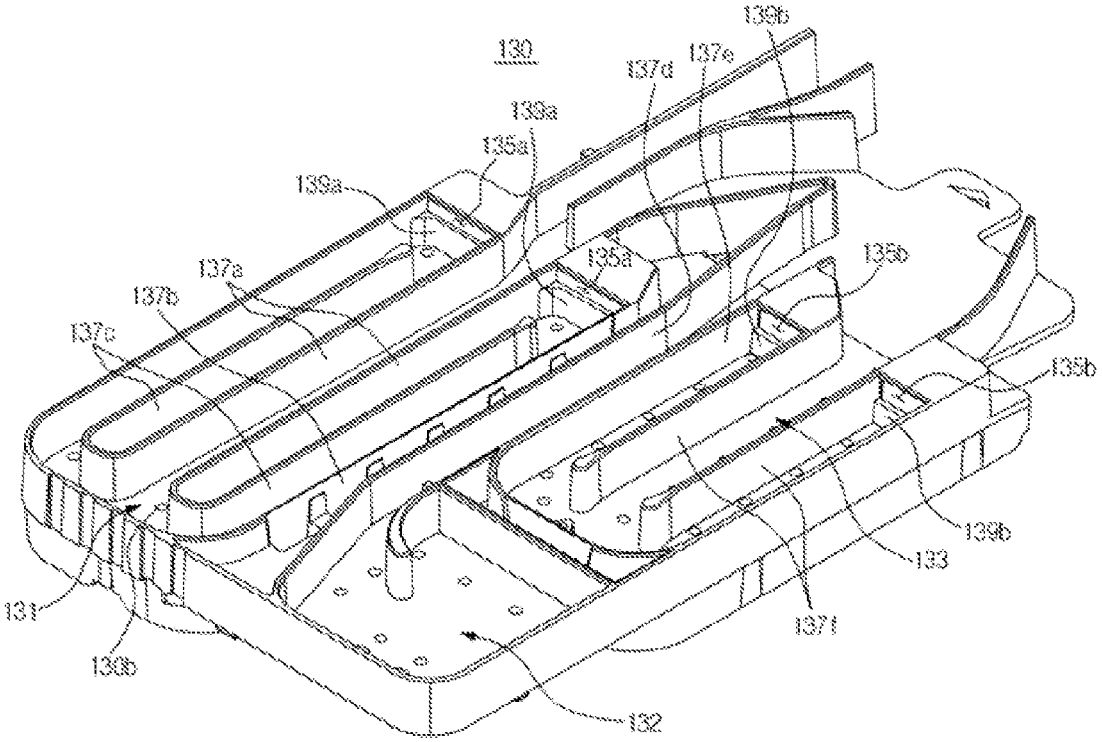
FIG. 9 is a perspective view illustrating the water supply frame depicted in FIG. 2.
Figure 10:
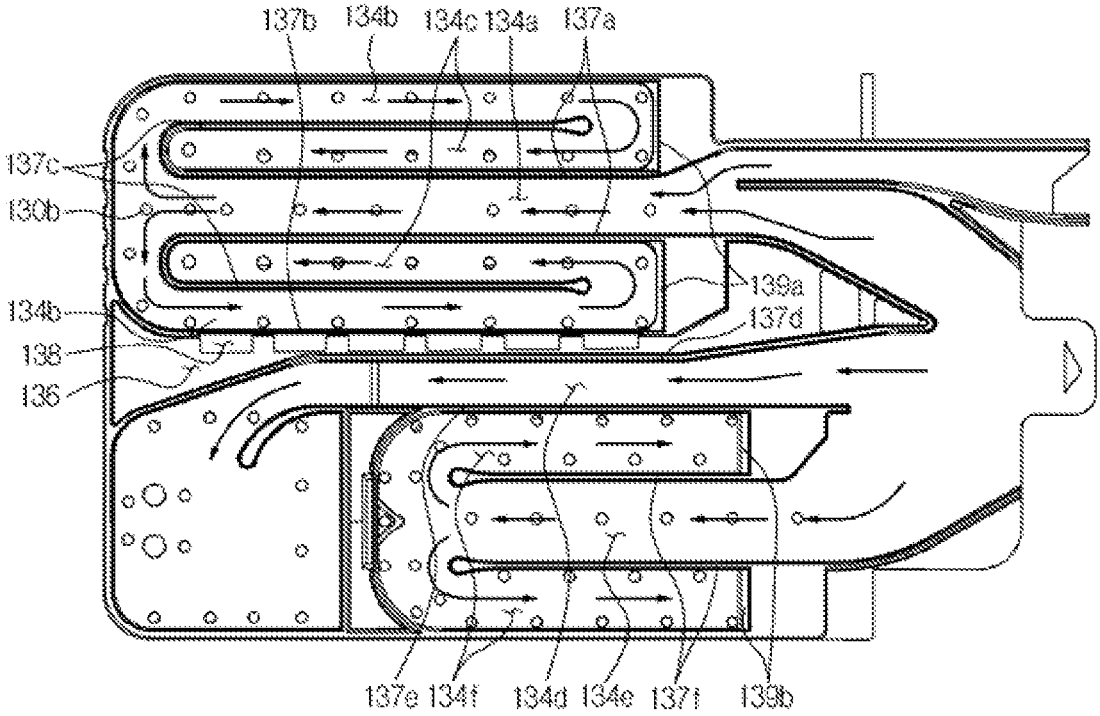
FIG. 10 is a view illustrating water flow along a water supply passage of the water supply frame depicted in FIG. 2.

FIG. 2 is an exploded perspective view of the detergent supply device according to an embodiment of the present disclosure, FIG. 3 is an exploded perspective view of the detergent supply device of FIG. 2, taken from a different angle, and FIG. 4 is an enlarged view of an A portion in FIG. 3. FIG. 5 is a plan view illustrating engagement of a water supply frame and a cover frame of the detergent supply device according to the embodiment of the present disclosure, and FIG. 6 is a bottom view illustrating engagement of the water supply frame and the cover frame of the detergent supply device according to the embodiment of the present disclosure. FIG. 7 is a sectional view taken along line I-I in FIG. 5, FIG. 8 is an enlarged view of a B portion in FIG. 7, FIG. 9 is a perspective view illustrating the water supply frame depicted in FIG. 2, and FIG. 10 is a view illustrating water flow along a water supply passage of the water supply frame depicted in FIG. 2. In FIG. 3, the detergent case 120 is omitted.

As shown in FIGS. 2 through 10, the detergent supply device 100 includes a housing 110, a detergent case 120 configured to store a detergent or a fabric softener and movably coupled to the housing 110, a water supply frame 130 coupled to an upper portion of the housing 110 in order to supply water to the housing 110, and a cover frame 140 sealingly cover an upper portion of the water supply frame 130.

The housing 110 includes a housing body 112 in which the detergent case 120 is received, an opening 114 formed at a front portion of the housing body 112, through which the detergent case 120 is withdrawn from the housing body 112, and rails 116 provided at opposite inner lateral surfaces of the housing body 112 in order to support the detergent case 120 so that the detergent case 120 may slide with respect to the housing 110.

A discharge port 118 is formed at a bottom surface of the housing body 112, through which a detergent or fabric softener mixed with water is discharged from the detergent supply device 100. The discharge port 118 is connected to the connection pipe 54. The detergent or fabric softener mixed with water discharged through the discharge port 118 is fed to the tub 20 via the connection pipe 54. The bottom surface of the housing body 112 is slanted downwardly toward the discharge port 118 so that the detergent or fabric softener mixed with water may not accumulate on the bottom surface of the housing body 112 but may be effectively discharged through the discharge port 118.

In order to fix the cover frame 140 to the housing 110, the housing body 112 is provided with a fixing part 119, and the cover frame 140 is provided with locking hooks 146. The fixing part 119 protrudes outwardly along an upper periphery of the housing body 112 so that the locking hooks 146 of the cover frame 140 may be hooked to the fixing part 119 when the housing 110 and the cover frame 140 are coupled.

The detergent case 120 is partitioned into a first storage part 121 to store a solid detergent, a second storage part 122 divided from the first storage part 121 by a first partition wall 124 to store a fabric softener, and a third storage part 123 divided from the first storage part 121 by the first partition wall 124 and divided from the second storage part 122 by a second partition wall 125 to store a liquid detergent. A liquid detergent discharge device 127 is provided at the third storage part 123 so as to effectively discharge a liquid detergent from the third storage part 123. The liquid detergent discharge device 127 includes a siphon pipe 127*a* protruding from a bottom surface of the third storage part 123 by a designated length, and a siphon cap 127*b* coupled to an outer portion of the siphon pipe 127*a*. A handle 128 may be provided in front of the first and second storage parts 121 and 122 to enable a user to put or withdraw the detergent case 120 into/from the housing 110.

The water supply frame 130 includes a first water supply part 131 disposed above the first storage part 121 of the detergent case 120 to supply water to a solid detergent stored in the first storage part 121, a second water supply part 132 disposed above the second storage part 122 of the detergent case 120 to supply water to a fabric softener stored in the second storage part 122, and a third water supply part 133 disposed above the third storage part 123 of the detergent case 120 to supply water to a liquid detergent stored in the third storage part 123.

The water supply frame 130 further includes a plurality of water supply passages 134 along which water supplied from an external water source (not shown) to the water supply frame 130 moves, and a plurality of through-holes 130*b* formed through a bottom surface of the water supply frame 130 so that water moving along the water supply passages 134 may drop into the detergent case 120 through the through-holes 130*b*.

The water supply passages 134 include a first water supply passage 134*a* configured to guide water supplied from an external water source to the water supply frame 130 to the first water supply part 131, second water supply passages 134*b* configured to communicate with the first water supply passage 134*a* and change a moving direction of the water having passed through the first water supply passage 134*a*, and third water supply passages 134*c* configured to communicate with the second water supply passages 134*b* and change a moving direction of the water having passed through the second water supply passages 134*b*.

In addition, the water supply passages 134 include a fourth water supply passage 134*d* configured to guide water supplied from an external water source to the water supply frame 130 to the second water supply part 132, a fifth water supply passage 134*e* configured to guide water supplied from an external water source to the water supply frame 130 to the third water supply part 133, and sixth water supply passages 134*f* configured to communicate with the fifth water supply passage 134*e* and change a moving direction of the water having passed through the fifth water supply passage 134*e*.

The first water supply passage 134*a* is interposed between a pair of third water supply passages 134*c*, and each of the third water supply passages 134*c* is interposed between the first water supply passage 134*a* and each of a pair of second water supply passages 134*b*. The fifth water supply passage 134*e* is interposed between a pair of sixth water supply passages 134*f*.

The reason of changing a moving direction of the water in the first water supply part 131 or the third water supply part 133 is that the water is evenly distributed in the water supply frame 130 and then drops into the detergent case 120, thereby enabling a detergent or a fabric softener in the detergent case 120 to be evenly dissolved in the water and supplied to the tub 20.

A drain passage 136 is provided between the first water supply part 131 and the second water supply part 132 or between one of the second water supply passages 134*b* and the fourth water supply passage 134*d*. A plurality of second drain slots 138 are formed through the drain passage 136 so that water passing through the drain passage 136 may be discharged to the housing 110. When a pressure of water supplied from an external water source to the water supply frame 130 is relatively high, the drain passage 136 temporarily stores water escaping from the first water supply part 131 and discharges the water to the housing 110 through the second drain slots 138, thereby preventing the water from moving to the second water supply part 132. Accordingly, the water to be supplied to a solid detergent is prevented from permeating a liquid detergent or a fabric softener.

The water supply passages 134 are defined by a plurality of passage ribs 137 protruding from an inner bottom surface of the water supply frame 130. The passage ribs 137 include first passage ribs 137*a* to define the first water supply passage 134*a*, a second passage rib 137*b* to define the second water supply passages 134*b*, and third passage ribs 137*c* disposed between the first passage ribs 137*a* and the second passage rib 137*b* to define the third water supply passages 134*c* with the first passage ribs 137*a* and define the second water supply passages 134*b* with the second passage rib 137*b*.

In addition, the passage ribs 137 include a fourth passage rib 137*d* to define the drain passage 136 with the second passage rib 137*b*, a fifth passage rib 137*e* to define the fourth water supply passage 134*d* with the fourth passage rib 137*d*, and sixth passage ribs 137*f* to define the sixth water supply passages 134*f* with the fifth passage rib 137*e* and define the fifth water supply passage 134*e* by being disposed parallel to and spaced apart from each other.

First guide ribs 139*a* are provided between the respective first passage ribs 137*a* and the second passage rib 137*b* in the vicinity of respective junctional regions between the second water supply passages 134*b* and the third water supply passages 134*c*. That is, one end portion of each of the first guide ribs 139*a* is connected to one end portion of each of the first passage ribs 137*a*, and the other end portion of each of the first guide ribs 139*a* is connected to one end portion of the second passage rib 137*b* opposing the one end portion of each of the first passage ribs 137*a*. When a pressure of water supplied from an external water source to the water supply frame 130 is relatively low, i.e., in a relatively low water pressure condition, the first guide ribs 139*a* serve to enable water introduced into the second water supply passages 134*b* to be evenly distributed and smoothly flow to the third water supply passages 134*c*, and also serve to prevent water at the junctional regions between the second water supply passages 134*b* and the third water supply passages 134*c* from being discharged through first drain slots 135*a* (which will be described later).

In addition, second guide ribs 139*b* are provided between the fifth passage rib 137*e* and the respective sixth passage ribs 137*f*. That is, one end portion of each of the second guide ribs 139*b* is connected to one end portion of the fifth passage rib 137*e*, and the other end portion of each of the second guide ribs 139*b* is connected to one end portion of each of the sixth passage ribs 137*f* opposing the one end portion of the fifth passage rib 137*e*. When a pressure of water supplied from an external water source to the water supply frame 130 is relatively low, i.e., in a relatively low water pressure condition, the second guide ribs 139*b* serve to prevent water introduced into the sixth water supply passages 134*f* from being discharged through second drain slots 135*b* (which will be described later).

The water supply frame 130 further includes first drain slots 135*a* formed above the first guide ribs 139*a* and communicating with the second water supply passages 134*b* and the third water supply passages 134*c*, and second drain slots 135*b* formed above the second guide ribs 139*b* and communicating with the sixth water supply passages 134*f*.

The first drain slots 135*a* are defined by the cover frame 140, the first passage ribs 137*a*, the second passage rib 137*b*, and the first guide ribs 139*a* which have a lower height than the first passage ribs 137*a* and the second passage rib 137*b*. When a pressure of water supplied from an external water source to the water supply frame 130 is relatively high, i.e., in a relatively high water pressure condition, if a level of water introduced into the second water supply passages 134*b* or the third water supply passages 134*c* becomes higher than the first guide ribs 139*a*, the first drain slots 135*a* allow the water in the second water supply passages 134*b* or the third water supply passages 134*c* to be discharged from the water supply frame 130, thereby decreasing an internal pressure of the water supply frame 130. Accordingly, the water supplied to the first water supply part 131 is prevented from moving to the second water supply part 132 or the third water supply part 133 through a gap between the water supply frame 130 and the cover frame 140. As a result, the water to be supplied to a solid detergent is prevented from permeating a liquid detergent or a fabric softener.

The second drain slots 135*b* are defined by the cover frame 140, the fifth passage rib 137*e*, the sixth passage ribs 137*f*, and the second guide ribs 139*b* which have a lower height than the fifth passage rib 137*e* and the sixth passage ribs 137*f*. When a pressure of water supplied from an external water source to the water supply frame 130 is relatively high, i.e., in a relatively high water pressure condition, if a level of water introduced into the sixth water supply passages 134*f* becomes higher than the second guide ribs 139*b*, the second drain slots 135*b* allow the water in the sixth water supply passages 134*f* to be discharged from the water supply frame 130, thereby decreasing an internal pressure of the water supply frame 130. Accordingly, the water supplied to the third water supply part 133 is prevented from moving to the first water supply part 131 through a gap between the water supply frame 130 and the cover frame 140. As a result, the water to be supplied to a liquid detergent or a fabric softener is prevented from permeating a solid detergent.

A plurality of gap forming protrusions 130*a* is provided at an outer bottom surface of the water supply frame 130. The gap forming protrusions 130*a* protrude from the outer bottom surface of the water supply frame 130 by a predetermined length, and are arranged corresponding to positions of coupling protrusions 144 (which will be described later) of the cover frame 140 so that a gap is formed between each of the gap forming protrusions 130*a* and each of the coupling protrusions 144. When the water supply frame 130 and the cover frame 140 are separated, a user may insert a tool such as a screwdriver into the gap between each of the gap forming protrusions 130*a* and each of the coupling protrusions 144, and may easily separate the water supply frame 130 and the cover frame 140 from each other using a principle of leverage.

The cover frame 140 sealingly covers the upper portion of the water supply frame 130. The cover frame 140 includes a receiving part 142 in which the water supply frame 130 is received, a plurality of coupling protrusions 144 protruding from an inner peripheral surface 142*a* of the receiving part 142 to support the bottom surface of the water supply frame 130, and a plurality of locking hooks 146 to fix the cover frame 140 coupled with the water supply frame 130 to the housing 110.

The plurality of coupling protrusions 144 is arranged apart from each other along the inner peripheral surface 142*a* of the receiving part 142. Each of the coupling protrusions 144 includes a contact surface 144*a* which contacts the bottom surface of the water supply frame 130 when the water supply frame 130 is received in the receiving part 142, and a slanted surface 144*b* connecting the contact surface 144*a* and the inner peripheral surface 142*a* of the receiving part 142. The slanted surface 144*b* is slanted downwardly from the contact surface 144*a* to the inner peripheral surface 142*a* of the receiving part 142. The water supply frame 130 is securely fixed to the cover frame 140 by the contact surface 144*a*. In coupling the water supply frame 130 and the cover frame 140, the slanted surface 144*b* comes into contact with an end portion of the water supply frame 130 and guides the water supply frame 130 to be inserted into the receiving part 142.

The plurality of locking hooks 146 is arranged along an outer peripheral surface of the cover frame 140, and are hooked to the fixing part 119 protruding outwardly along the upper periphery of the housing 110, to thereby fix the cover frame 140 coupled with the water supply frame 130 to the housing 110.

As described above, the components of the detergent supply device 100, that is, the housing 110, the water supply frame 130 and the cover frame 140 may be simply assembled using the plurality of coupling protrusions 144 and the plural locking hooks 146 provided at the cover frame 140. Accordingly, manufacturing time and costs may be reduced, and productivity may be enhanced. In addition, even though it is in a relatively low water pressure condition, water may be evenly distributed in the water supply frame 130 by the first guide ribs 139*a* and the second guide ribs 139*b* provided at the water supply frame 130. Further, in a relatively high water pressure condition, the first drain slots 135*a* and the second drain slots 135*b* may prevent water from leaking through a gap between the water supply frame 130 and the cover frame 140.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A detergent supply device of a washing machine comprising:

a housing having an opening;

a detergent case to store a detergent, the detergent case being movably coupled to the housing through the opening;

a water supply frame coupled to an upper portion of the housing to guide water to the detergent case; and a cover frame to sealingly cover an upper portion of the water supply frame, wherein the water supply frame includes:

a first passage rib to define a first water supply passage;

a second passage rib to define a second water supply passage which communicates with the first water supply passage and guides water in a direction different from the first water supply passage; and a guide rib connecting the first passage rib and the second passage rib and to guide water in a direction different from a direction of the second water supply passage, wherein the water supply frame further includes a drain slot communicating with an outer bottom surface of the water supply frame and formed above the guide rib so that water in the water supply frame flows through the drain slot toward the outer bottom surface of the water supply frame when a level of water in the water supply frame is higher than a height of the guide rib.

2. The detergent supply device according to claim 1, wherein when the level of water in the water supply frame is lower than the height of the guide rib, the guide rib guides water passing through the first water supply passage toward the second water supply passage, and when the level of water in the water supply frame is higher than the height of the guide rib, the guide rib guides at least a portion of water in the water supply frame toward the drain slot.

3. The detergent supply device according to claim 1, wherein the guide rib has a lower height than the first passage rib and the second passage rib.

4. The detergent supply device according to claim 1, wherein the drain slot is defined by the guide rib, the first passage rib and the second passage rib.

5. The detergent supply device according to claim 1, wherein the water supply frame further includes at least one third passage rib disposed between the first passage rib and the second passage rib, and wherein the third passage rib includes a first surface to define a third water supply passage with the first passage rib, and a second surface to define the second water supply passage with the second passage rib, the second surface being opposite to the first surface.

6. The detergent supply device according to claim 1, wherein the cover frame includes a plurality of coupling protrusions protruding from an inner peripheral surface thereof to support a bottom surface of the water supply frame.

7. A washing machine comprising:

a main body;

a drum rotatably mounted in the main body; and a detergent supply device disposed at an upper portion of the main body to supply a detergent into the drum, wherein the detergent supply device includes:

a housing;

a detergent case to store a detergent, the detergent case being movably coupled to the housing;

a water supply frame coupled to an upper portion of the housing to guide water to the detergent case; and a cover frame to sealingly cover an upper portion of the water supply frame, the cover frame including a plurality of coupling protrusions protruding from an inner peripheral surface thereof to support a bottom surface of the water supply frame, wherein the plurality of coupling protrusions is arranged apart from each other along the inner peripheral surface of the cover frame, and each of the coupling protrusions includes a contact surface configured to be in contact with the bottom surface of the water supply frame when the water supply frame and the cover frame are in a coupled state, and a slanted surface connecting the contact surface and the inner peripheral surface of the cover frame, the slanted surface being slanted downwardly from the contact surface to the inner peripheral surface of the cover frame.

8. The washing machine according to claim 7, wherein the cover frame further includes a plurality of locking hooks to fix the cover frame coupled with the water supply frame to the housing, and wherein the plurality of locking hooks is arranged along an outer peripheral surface of the cover frame.

9. The washing machine according to claim 7, wherein the water supply frame includes:

water supply passages through which water supplied from an external water source moves;

a plurality of through-holes formed through the bottom surface of the water supply frame, through which water moving along the water supply passages drops into the detergent case; and at least one guide rib provided in the water supply passages and configured to enable water introduced into a portion of the water supply passages to change a moving direction and move toward another portion of the water supply passages.

10. The washing machine according to claim 9, wherein the at water supply passages includes:

at least one first water supply passage into which water supplied from an external water source is introduced;

at least one second water supply passage configured to communicate with the at least one first water supply passage and change a moving direction of water having passed through the at least one first water supply passage; and at least one third water supply passage configured to communicate with the at least one second water supply passage and change a moving direction of water having passed through the at least one second water supply passage, and wherein the at least one guide rib is disposed at a junctional region between the at least one second water supply passage and the at least one third water supply passage to enable water passing through the at least one second water supply passage to move toward the at least one third water supply passage.

11. The washing machine according to claim 10, wherein the at least one third water supply passage is disposed between the at least one first water supply passage and the at least one second water supply passage.

12. The washing machine according to claim 11, wherein the at least one second water supply passage is provided in at least two parts which are arranged while interposing the at least one first water supply passage therebetween.

13. The washing machine according to claim 10, wherein the water supply frame further includes a plurality of passage ribs protruding from an inner bottom surface thereof to define the water supply passages, and wherein the at least one guide rib has a lower height than the passage ribs.

14. The washing machine according to claim 13, wherein the at least one guide rib has a first end portion connected to one end portion of a first passage rib defining the at least one first water supply passage and the at least one third water supply passage, and a second end portion connected to one end portion of a second passage rib defining the at least one second water supply passage.

15. The washing machine according to claim 14, wherein the water supply frame further includes at least one drain slot which is defined by the cover frame, the first passage rib, the second passage rib and the at least one guide rib.

16. The washing machine according to claim 15, wherein the at least one drain slot communicates with the second water supply passage and the third water supply passage.

17. The washing machine according to claim 9, wherein the water supply frame further includes at least one drain slot, each of the at least one drain slot respectively formed above the at least one guide rib, and wherein when a level of water introduced into the water supply passages is higher than a height of the at least one guide rib, the at least one drain slot allows the water in the water supply passage to be discharged from the water supply frame.

18. A washing machine comprising:

a main body;

a drum rotatably mounted in the main body; and a detergent supply device disposed at an upper portion of the main body to supply a detergent into the drum, wherein the detergent supply device includes:

a housing;

a detergent case to store a detergent, the detergent case being movably coupled to the housing;

a water supply frame coupled to an upper portion of the housing to guide water to the detergent case; and a cover frame to sealingly cover an upper portion of the water supply frame, the cover frame including a plurality of coupling protrusions protruding from an inner peripheral surface thereof to support a bottom surface of the water supply frame, wherein the water supply frame includes a plurality of gap forming protrusions protruding from an outer bottom surface thereof and arranged corresponding to positions of the coupling protrusions so that a gap is formed between each of the gap forming protrusions and each of the coupling protrusions.

* * * * *